US010132573B2

(12) United States Patent
Citti et al.

(10) Patent No.: US 10,132,573 B2
(45) Date of Patent: Nov. 20, 2018

(54) HEAT EXCHANGER, IN PARTICULAR FOR A VEHICLE

(71) Applicant: Valeo Systemes Thermiques, Le Mesnil Saint Denis (FR)

(72) Inventors: Isabelle Citti, Rosnay (FR); Jugurtha Benouali, Clamart (FR); Regis Beauvis, Suresnes (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 125 days.

(21) Appl. No.: 14/388,827

(22) PCT Filed: Mar. 25, 2013

(86) PCT No.: PCT/EP2013/056322

§ 371 (c)(1),
(2) Date: Sep. 29, 2014

(87) PCT Pub. No.: WO2013/149879

PCT Pub. Date: Oct. 10, 2013

(65) Prior Publication Data

US 2015/0053383 A1 Feb. 26, 2015

(30) Foreign Application Priority Data

Mar. 30, 2012 (FR) ..... 12 52934

(51) Int. Cl.
*F28F 9/02* (2006.01)
*F28D 7/16* (2006.01)
(Continued)

(52) U.S. Cl.
CPC ..... *F28F 9/028* (2013.01); *F28D 1/05375* (2013.01); *F28D 7/16* (2013.01);
(Continued)

(58) Field of Classification Search
CPC ..... F28D 1/05391; F28D 1/05375; F28F 9/0209; F28F 9/0212; F28F 9/028; F28F 2009/228
(Continued)

(56) References Cited

U.S. PATENT DOCUMENTS 5,341,872 A * 8/1994 Mercurio ..... F28F 9/0212 165/173
6,062,303 A * 5/2000 Ahn ..... F25B 39/04 165/110
(Continued)

FOREIGN PATENT DOCUMENTS

EP 0 887 611 A2 12/1998
JP 03140764 A * 6/1991 ..... F28F 9/028
(Continued)

OTHER PUBLICATIONS

International Search Report for Application No. PCT/EP2013/056322 dated Apr. 24, 2013, 7 pages.
(Continued)

*Primary Examiner* — Devon Russell
(74) *Attorney, Agent, or Firm* — Howard & Howard Attorneys PLLC

(57) ABSTRACT

The invention relates to a heat exchanger, said exchanger including a bundle of tubes (2), which enables an exchange of heat between a refrigerant circulating in said tubes (2) and an external airflow, and a first collector (4), said exchanger being configured so as to establish the serial circulation of the refrigerant among a first portion of said tubes (2) leading into a first portion (4*a*) of said first collector, said first collector (4), and a second portion of said tubes (2) leading into a second portion (4*b*) of said first collector (4). According to the invention, said first collector (4) includes a partition (12) configured to disrupt the circulation of the fluid between the first and second portions of said tubes (2).
(Continued)

The invention is specifically for electric and/or hybrid motor vehicles.

11 Claims, 2 Drawing Sheets

(51) Int. Cl.
*F28F 9/22* (2006.01)
*F28D 1/053* (2006.01)

(52) U.S. Cl.
CPC ..... *F28F 9/0212* (2013.01); *F28F 9/0265* (2013.01); *F28D 1/05391* (2013.01); *F28F 9/0209* (2013.01); *F28F 2009/228* (2013.01)

(58) Field of Classification Search
USPC ..... 165/174
See application file for complete search history.

(56) References Cited

U.S. PATENT DOCUMENTS 6,250,103 B1 * 6/2001 Watanabe ..... F25B 39/04 62/509
6,684,662 B2 * 2/2004 Manaka ..... F25B 39/04 62/503
7,096,930 B2 * 8/2006 Nobuta ..... F25B 39/04 165/132
7,757,753 B2 * 7/2010 Yanik ..... B23K 1/0012 165/174
9,115,934 B2 * 8/2015 Kopchick ..... F28D 1/05375
2008/0023185 A1 * 1/2008 Beamer ..... F28D 1/05375 165/174
2015/0053383 A1 * 2/2015 Citti ..... F28F 9/0212 165/173

FOREIGN PATENT DOCUMENTS

JP H 03-140764 A 6/1991
JP H 11-337293 A 12/1999
JP 2001-235255 A 8/2001
JP 2005-140374 A 6/2005
WO WO 2007/083680 A1 7/2007

OTHER PUBLICATIONS

English language abstract for JPH 03-140764 extracted from PAJ database on Oct. 9, 2014, 1 page.
English language abstract and machine-assisted English translation for JPH 11-337293 extracted from PAJ database on Oct. 9, 2014, 18 pages.
English language abstract and machine-assisted English translation for JP 2001-235255 extracted from the PAJ database on Oct. 9, 2014, 19 pages.
English language abstract and machine-assisted English translation for JP 2005-140374 extracted from PAJ database on Oct. 9, 2014, 26 pages.
English language abstract for WO 2007/083680 extracted from espacenet.com database on Oct. 9, 2014, 1 page.

* cited by examiner

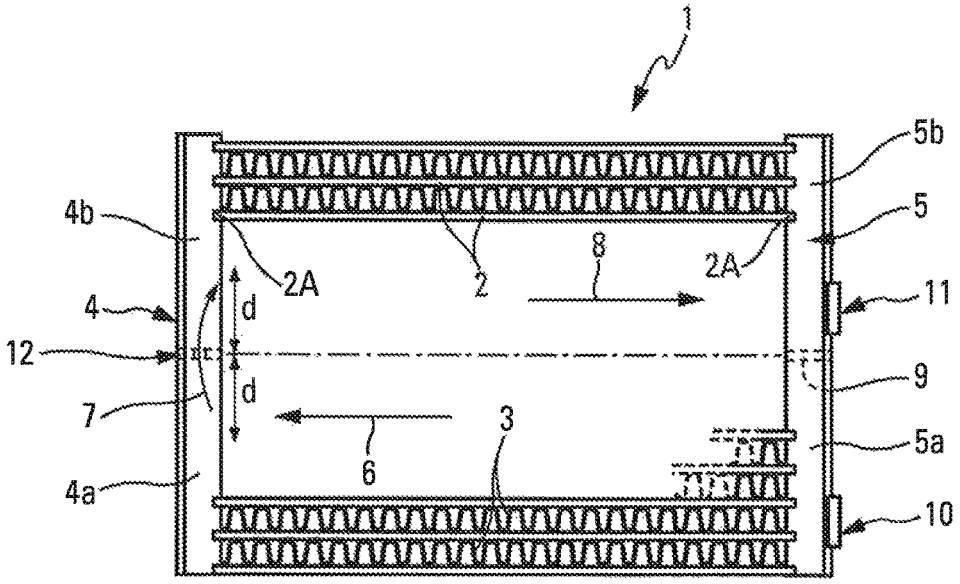
Fig. 1
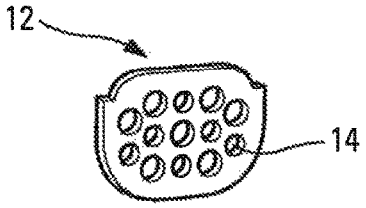
Fig. 2
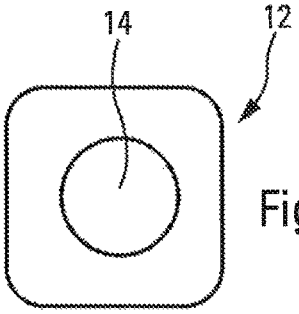
Fig. 3
Fig. 5
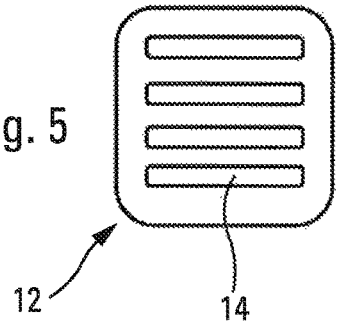
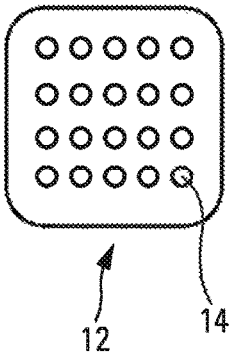
Fig. 4

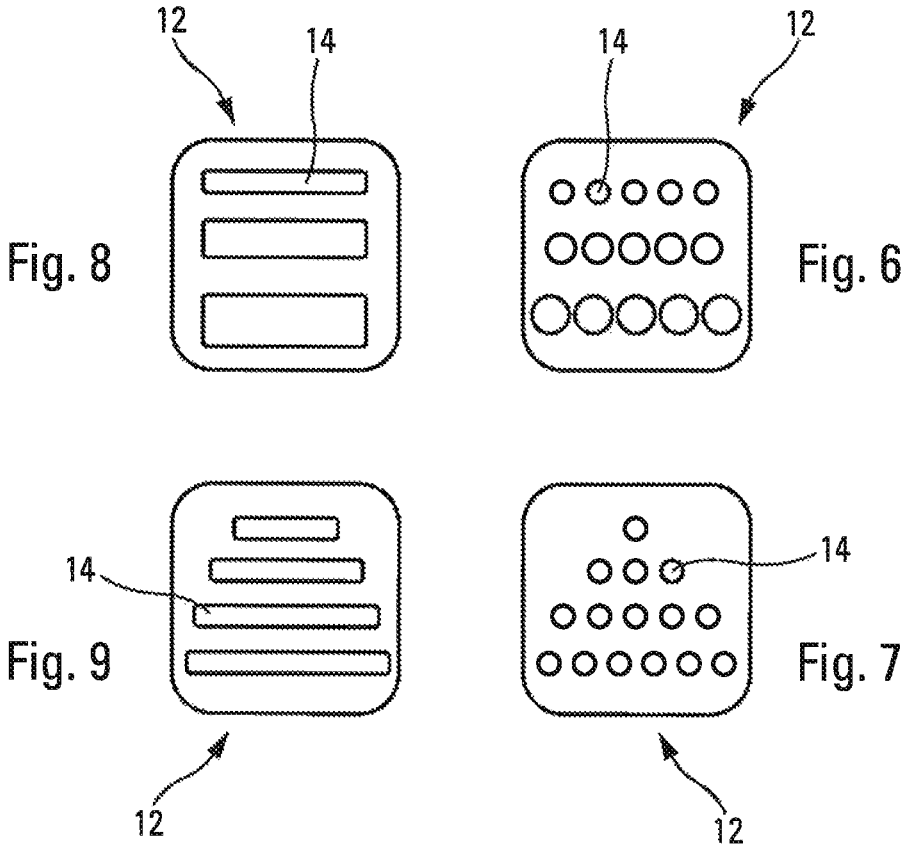
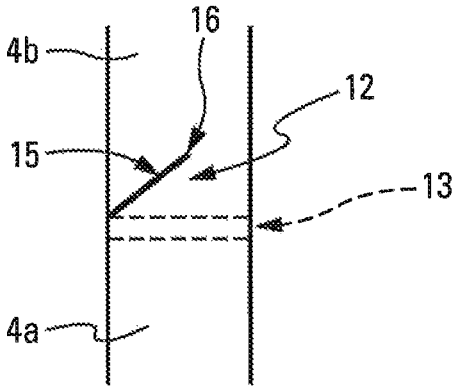
Fig. 10

HEAT EXCHANGER, IN PARTICULAR FOR A VEHICLE

CROSS-REFERENCE TO RELATED APPLICATIONS

This application is the National stage of International Patent Application No. PCT/EP2013/056322, filed on Mar. 25, 2013. which claims priority to and all advantages of French Patent Application No. 12/52934, filed on Mar. 30, 2012, the content of which is incorporated herein by reference.

The invention concerns a heat exchanger, in particular for vehicles, especially electric and/or hybrid vehicles.

BACKGROUND

In vehicles with a thermal engine, using the heat given off by the engine to heat the vehicle passenger compartment is known. In vehicles with an electric motor, the heat given off by the electric machine used to drive the vehicle is too small to fulfill such a function. An identical problem is posed, even if this is to a lesser degree, in hybrid vehicles, that is to say with a both thermal and electric drive.

To solve this problem, it has already been proposed to operate air-conditioning loops reversibly. They are thus configured so as to introduce alternately cold air or hot air into the passenger compartment, according to the request from the user.

They use a heat exchanger, situated at the front face of the vehicle, so as to be swept by an airflow at ambient temperature passing through the radiator grille. Said exchanger serves to condense the refrigerant fluid circulating in the air-conditioning loop when said air-conditioning loop is used to cool the passenger compartment and to evaporate said fluid in the opposite case, that is to say when the air-conditioning loop is functioning as a heat pump to heat the passenger compartment.

The thermal performance of such heat exchangers is difficult to optimise since the solutions for improving the functioning thereof as a condenser are generally opposed to those for improving the functioning thereof as an evaporator.

More precisely, in condensers or evaporators of the interlayered tube type, it has been known for a long time that it is advantageous to circulate the refrigerant fluid serially in passes containing a given number of tubes. In condensers, it has also been known for a long time that decreasing the number of tubes from one pass to another optimises the heat exchange while limiting losses of pressure. Persons skilled in the art also know that such a distribution of tubes is on the other hand unfavourable to the functioning of evaporators.

A first solution for avoiding this situation is to reverse the direction of circulation of the fluid in the heat exchanger, but such a solution increases the complexity of the air-conditioning loop.

For heat exchangers that are to serve alternately as condenser and evaporator, without reversal of the direction of circulation of the refrigerant fluid in the heat exchanger, a person skilled in the art is then naturally led to propose heat exchangers having a configuration that is as symmetrical as possible in order to avoid being detrimental to one operating mode with respect to the other. In the case of heat exchangers of the interlayered tube type with a plurality of passes, this results in the use of two passes, having an identical number of tubes per pass or at the least that remains similar from one pass to another.

This being the case, a particularly critical problem is the risk of icing of the heat exchanger in heat pump mode. The appearance of such a phenomenon tends to stop all or some of the heat exchange because of the increase in the loss of air pressure. The degradation of the heat exchange due to the icing tends to reduce the evaporation temperature and the pressure of the refrigerant fluid inside the heat exchanger, which increases the risk of icing of the exchanger accordingly.

Another particularly critical problem relates to the loss of pressure internal to the heat exchanger. In evaporator mode, it is known that the density of the refrigerant fluid is lower than in condenser mode, which has the effect of increasing the loss of pressure. It thus appears essential to seek to reduce the loss of pressure in evaporator functioning in order to improve the thermal performance.

To avoid such a risk, the use of a smaller number of tubes in the first pass has already been considered, while placing this first pass in the bottom portion of the exchanger, the exchanger being positioned in a substantially vertical plane and the tubes being oriented substantially horizontally.

SUMMARY OF THE INVENTION

Tests carried out by the applicant have however shown that some of the tubes of such an exchanger participate little or not at all in the exchange. These are in particular tubes in the second pass situated close to the first pass. It appears moreover that this problem is more general and is encountered also in heat exchangers having a larger number of passes, a different distribution of the tubes per pass and/or a different, in particular vertical, orientation of the tubes.

The present invention aims to improve the situation and for this purpose proposes a heat exchanger, said heat exchanger comprising a bundle of tubes, providing an exchange of heat between a refrigerant fluid circulating in said tubes and an external airflow, and a first header, said heat exchanger being configured so as to establish a serial circulation for the refrigerant fluid between a first portion of said tubes, emerging in a first portion of said first header, said first header and a second portion of said tubes, emerging in a second portion of said first header.

According to the invention, said first header comprises a partition configured so as to disturb the circulation of fluid between the first and second portions of said tubes.

The applicant has found that the use of such a partition improves the distribution of the refrigerant fluid inside the tubes of the bundle, which has the effect of increasing the heat exchange whilst controlling losses of pressure, in particular in evaporator operating mode. Although it seems that this type of partition must accelerate the refrigerant fluid by reducing its cross section of flow and therefore being unfavourable to the supply to the tubes situated downstream, on the contrary an improved supply to said tubes is observed. Without claiming to constitute an explanation, such a phenomenon could originate in the two-phase state of the refrigerant fluid when it goes from one pass to another.

According to various embodiments, which can be used separately or in combination:

- the tubes in the bundle are distributed in a first and second pass, corresponding respectively to the first portion and to the second portion of said tubes,
- the bundle is configured so that the passes are oriented horizontally when the heat exchanger is in use, the cross section of flow for the refrigerant fluid in the first pass represents 40% to 70%, in particular 50% to 70%, of the cross section of flow for the refrigerant fluid in the bundle, the cross section of flow for the refrigerant fluid in the first pass is strictly greater than 40%, in particular 50%, the partition is situated at a distance d from a passage zone between the first portion and the second portion of said first header, and the partition is positioned as required:

in said first portion, the distance d being less than half the axial length of said first portion of said first header, in said second portion, the distance d being less than half the axial length of said second portion of said first header, the partition is situated at said passage zone, the partition is configured so as to orient the refrigerant fluid preferentially towards tube portions situated close to a partition, referred to as the separation partition, of a second header of the heat exchanger in which the tubes of said bundle emerge, said separation partition defining said serial circulation, that is to say in a plurality of passes in the bundle, said tubes in the second tube portion situated close to said separation partition are situated opposite an orifice for the refrigerant fluid to leave the heat exchanger, the partition disturbing the circulation of the refrigerant fluid is a deflector oriented so as to direct the refrigerant fluid towards the bundle, the partition disturbing the circulation of the refrigerant fluid is arranged transversely to a longitudinal axis of the first header, the partition disturbing the circulation of the refrigerant fluid has one or more passage orifices for said fluid, the passage orifices are regularly distributed on the surface of the partition disturbing the circulation of refrigerant fluid, the passage orifices are distributed so as to channel the fluid in the direction of the tubes of the second tube portion situated close to the separation partition, the passage orifices are more numerous and/or have a larger surface area in half of the partition disturbing the circulation of the refrigerant fluid, situated close to the tubes, said heat exchanger is configured so as to be positioned at the front face of the motor vehicle, said vehicle being in particular an electric and/or hybrid vehicle.

BRIEF DESCRIPTION OF THE DRAWINGS

The invention will be better understood, and other aims, details, features and advantages thereof will emerge more clearly during the following detailed explanatory description of a plurality of embodiments of the invention given by way of purely illustrative and non-limitative examples, with reference to the accompanying drawings.

In these drawings:

FIG. 1 illustrates, in front view, schematically, an example of a heat exchanger according to the invention, FIG. 2 illustrates in perspective a first embodiment of a partition disturbing the circulation of refrigerant fluid of a heat exchanger according to the invention, FIGS. 3 to 9 illustrate in front view other embodiments of said partition, FIG. 10 illustrates schematically, along an axial cutting plane, an additional embodiment of said partition.

DETAILED DESCRIPTION

As illustrated in FIG. 1, the invention concerns a heat exchanger 1 configured so as to function alternately in evaporator mode and in condenser mode. It is in particular a heat exchanger intended to be used in an air-conditioning loop in the passenger compartment of a vehicle, in particular a motor vehicle, able to serve alternately to heat and to air-condition the passenger compartment. Thus, when a request from the user is a heating request, the loop will function as a heat pump and the heat exchanger will serve as an evaporator. When the request from the user is a request for air conditioning, the loop will function as a cooling loop and the heat exchanger will serve as a condenser. The invention will in particular find its application in vehicles with an electric and/or hybrid drive, for the reasons already explained above.

Said heat exchanger comprises a bundle of tubes 2, affording an exchange of heat between a refrigerant fluid circulating in said tubes and an external airflow. It can for this purpose be provided with inserts 3, in particular corrugated inserts, situated between the tubes 2 in order to increase the exchange surface area between the tubes and the external airflow.

Said heat exchanger in this case comprises first and second headers 4, 5 in which the tubes emerge through the opposite ends 2A of said tubes 2. Said tubes 2 are, for example, parallel to one another. They may have substantially the same length. Said headers 4, 5 are in this case parallel and oriented substantially perpendicular to the tubes 2.

Preferably, the tubes lie substantially parallel to the transverse axis of the vehicle, the headers therefore lying at right angles to the tubes.

The refrigerant fluid circulates in the heat exchanger in at least two passes. The exchanger is thus configured so as to establish a serial circulation for the refrigerant fluid passing first of all, in the direction of an arrow marked 6, in a first portion 4 of said tubes 2, emerging in a first portion 4*a* of the first header 4, next passing, in the direction of an arrow marked 7, in said first header 4 and finally passing, in the direction of an arrow marked 8, in a second portion of said tubes 2, emerging in a second portion 4*b* of said first header 4. The refrigerant fluid circulates in the heat exchanger from bottom to top, that is to say from the first pass arranged beneath the second pass along a vertical axis of the point of reference associated with the vehicle.

In order to provide circulation in various passes, the first header 4 and/or the second header 5 are provided with partitions 9, referred to as separation partitions, dividing said headers into various chambers 5*a*, 5*b* and forcing the refrigerant fluid to pass through the tubes 2 connected to the upstream chamber, situated on one side of one of said separation partitions, and then through the opposite header and through the tubes connected to the downstream chamber, situated on the other side of said separation partition. Said separation partitions are preferably sealed.

The tubes 2 of the bundle are here distributed in a first pass and a second pass, corresponding respectively to the first portion and second portion of said tubes 2. In FIG. 1, said passes are separated by a dot and dash line. In such a case, a single separation partition 9, situated in the second header 5, at the separation between the passes, is used. It is here shown in dotted lines since it is situated inside said second header 5.

Said heat exchanger may also comprise, for example, an inlet 10 and/or an outlet 11 for the refrigerant fluid, here situated on the same header, in this case the second header 5.

According to the invention, said first header 4 comprises a partition 12 configured so as to disturb the circulation of fluid between the first portion and the second portion of said tubes 2, namely, in this case, the first pass and the second pass.

It has been found that said partition 12 for disturbing the circulation of fluid between the two passes promotes better distribution of the flow of refrigerant fluid in all the tubes in a bundle, more precisely when this flow takes place from bottom to top. The heat exchange is thus improved while controlling losses of pressure.

It should be noted that the partition or partitions disturbing the circulation of refrigerant fluid are functions different from those of the separation partitions. The separation partitions serve to define a circulation in a plurality of passes in the bundle while the partitions disturbing the circulation of refrigerant fluid serve, said circulation in passes being established, to make the flow of fluid turbulent when it goes from one pass to another. The partition or partitions disturbing the circulation of refrigerant fluid are also situated inside the header or headers; the one illustrated in FIG. 1 is shown in dotted lines.

The refrigerant fluid in the first pass represents, for example, 50% to 70% of the cross section of flow for the refrigerant fluid in the bundle. According to a first variant, the cross section of flow for the refrigerant fluid is identical in each pass. In other words, if the tubes 2 in the bundle are all identical, each pass has the same number of tubes 2.

This being the case, according to another variant, it was found that superior results were obtained by using a cross section of flow for the refrigerant fluid in the first pass strictly greater than 50%, and in particular approximately 60%. By virtue of said partition disturbing the flow of fluid, although then favouring operation in the form of a condenser operation in the form of an evaporator remains satisfactory. In other words, according to this other variant, if the tubes 2 in the bundle are all identical, the first pass comprises 50% to 70% of the tubes, in particular 60% of the tubes 2.

Said disturbance partition 12 is situated here at a passage zone 13 between the first 4*a* and second portion 4*b* of the first header 4. This being the case, in a variant, it may be slightly at a distance. More precisely, it may be situated at a distance d from said passage zone 3 while being positioned either in said first portion 4*a*, the distance d then being less than half an axial length of said first portion 4*a* of the first header 4, or in said second portion 4*b*, the distance d then being less than half the axial length of said second portion 4*b* of the first header 4.

The partition 12 disturbing the circulation of the refrigerant fluid can be configured so as to orient the refrigerant fluid preferentially towards the tubes 2 of the second tube portion situated close to the separation partition 9 situated in the second header 5. It can be seen that the tubes 2 in question are here opposite the outlet 11 for the refrigerant fluid, and arranged above the disturbance partition 12.

According to a first embodiment, the partition 12 disturbing the circulation of refrigerant fluid is arranged, for example, transversely, in particular perpendicular, to a longitudinal axis of the first header and has one or more passage orifices for the refrigerant fluid. What is meant by this is that said partition 12 disturbing the circulation of refrigerant fluid has a periphery coming into contact with the first header 4 while following the internal contour thereof. Said passage orifices have in particular a round or rectangular cross section. They are through-orifices and allow said refrigerant fluid to pass from said first 4*a* to said second 4*b* portion of the first header 4. The partitions illustrated in FIG. 2 to 9 correspond to this embodiment.

According to the variants in FIGS. 2, 4 and 5, the passage orifices 14 are regularly distributed on the surface of the partition.

According to the variant in FIG. 3, a single passage orifice 14 is provided, in particular at the centre of the partition.

According to the variants in FIG. 6 to 9, the passage orifices 14 are distributed so as to channel the refrigerant fluid in the direction of the tubes in the second tube portion 2 situated close to the separation partition 9 of the second header 5. Said passage orifices 14 are thus more numerous and/or have a larger surface area in a half of the partition situated close to the tubes 2.

According to the variant in FIG. 6, the passage orifices 14 are distributed in parallel rows, each having the same number of orifices, the cross section of the passage orifices increasing from one row to the next.

According to the variant in FIG. 7, the passage orifices 14 have the same cross section and are distributed in parallel rows having an increasing number of orifices.

According to the variant in FIG. 8, the passage orifices 14 extend in the same transverse direction and have the same dimension in said transverse direction while their dimension in the direction perpendicular to said transverse direction increases from one passage orifice 14 to the next.

According to the variant in FIG. 9, the passage orifices 14 extend in the same transverse direction and have an increasing dimension in this direction from one passage orifice 14 to the next, their dimension in the direction perpendicular to said transverse direction remaining constant.

In an additional variant, not illustrated, the partition 12 disturbing the circulation of refrigerant fluid may consist of an element of the filter type arranged transversely in the first header 4.

According to the embodiment in FIG. 10, the partition 12 disturbing the circulation of refrigerant fluid is a deflector 15 oriented so as to direct the refrigerant fluid towards the bundle. The said deflector 15 extends over only a portion of the first header 4 and has a free edge 16 turned towards the second portion 4*b* of said header 4.

Said exchanger is, for example, made of aluminium or aluminium alloy. It is produced for example by brazing. The tubes 2 may be of the flat type and/or have a plurality of circulation channels for the refrigerant fluid. They are, for example, extruded tubes or tubes provided with an internal disturbance member defining said channels. The headers 4, 5 have, in particular, a substantially rectangular cross section. They may be formed by a header plate, in which said tubes 2 are inserted through corresponding orifices, and a cover closing said headers in combination with two end partitions.

Said heat exchanger is in particular configured so as to be positioned on the front face of a motor vehicle, in a substantially vertical orientation, the circulation of the refrigerant fluid taking place from bottom to top. In other words, the first pass is, for example, the bottom pass.

The invention claimed is:

1. A heat exchanger comprising:

a bundle of tubes (2) that afford an exchange of heat between a refrigerant fluid circulating in said tubes (2) and an external airflow; and a first header (4) comprising a partition (12) configured to disturb a circulation of fluid between a first portion of said tubes (2) and a second portion of said tubes (2), and a second header (5) comprising a second partition (9), wherein said heat exchanger is configured to establish a serial circulation for the refrigerant fluid between said first portion of said tubes (2) that are partially disposed in a first portion (4*a*) of said first header (4), and said second portion of said tubes (2) that are partially disposed in a second portion (4*b*) of said first header (4), wherein said partition (12) configured to disturb the circulation of fluid has a plurality of passage orifices (14) for the refrigerant fluid, and wherein said plurality of refrigerant fluid passage orifices (14) are regularly distributed on a surface of said partition (12), and wherein the refrigerant fluid circulates in said heat exchanger in only two passes and said partition (12) and said second partition (9) are disposed between said two passes, and wherein said two passes comprise a first pass including an inlet (10) and a second pass including an outlet (11), and said first pass is disposed below said partition (12) and said second partition (9) such that the refrigerant fluid circulates from bottom to top, and wherein said partition (12) is a deflector (15) oriented to direct the refrigerant fluid towards said bundle of tubes (2), wherein said deflector (15) is at an acute angle with respect to a longitudinal axis of said first header (4) and wherein said deflector (15) is situated at a passage zone (13) between said first portion (4*a*) and said second portion (4*b*) of said first header (4).

2. The heat exchanger according to claim 1, wherein said tubes (2) are distributed in said first pass and said second pass, corresponding respectively to said first portion of said tubes (2) and said second portion of said tubes (2).

3. The heat exchanger according to claim 2, wherein a cross section of flow for the refrigerant fluid in said first pass represents 40% to 70% of a cross section of flow for the refrigerant fluid in said bundle of tubes (2).

4. The heat exchanger according to claim 2, wherein a cross section of flow for the refrigerant fluid in said first pass is greater than 40%.

5. The heat exchanger according to claim 1, wherein said partition (12) is configured to move the refrigerant fluid towards said tubes (2) in a second tube portion situated adjacent to said second partition (9) of said second header (5) of said heat exchanger in which said tubes (2) are partially disposed in, wherein said second partition (9) defines said serial circulation.

6. The heat exchanger according to claim 5, wherein said tubes (2) in said second tube portion situated adjacent to said second partition (9) are situated opposite said outlet (11) for the refrigerant fluid to leave said heat exchanger.

7. The heat exchanger according to claim 1, wherein said plurality of refrigerant fluid passage orifices (14) are distributed to channel the fluid in the direction of said tubes (2) in said second tube portion situated adjacent to said second partition (9) of said second header (5) of said heat exchanger in which said tubes (2) are partially disposed in, wherein said second partition (9) defines said serial circulation.

8. The heat exchanger according to claim 1, wherein said plurality of refrigerant fluid passage orifices (14) are more numerous or have a larger surface area in a half of said partition (12) configured to disturb the circulation of fluid situated adjacent to said tubes (2).

9. The heat exchanger according to claim 1, wherein said heat exchanger is configured to be positioned on a front face of a motor vehicle.

10. The heat exchanger according to claim 1, wherein said heat exchanger is configured to operate in an evaporator mode and in a condenser mode.

11. The heat exchanger according to claim 6, wherein said outlet (11) is disposed adjacent to said second partition (9).

* * * * *